US008113838B2

(12) United States Patent
Tran

(10) Patent No.: US 8,113,838 B2
(45) Date of Patent: Feb. 14, 2012

(54) SIMULATED LAND MINE

(75) Inventor: Khanh Tran, San Jose, CA (US)

(73) Assignee: Real Action Paintball Inc., San Jose, CA (US)

( * ) Notice: Subject to any disclaimer, the term of this patent is extended or adjusted under 35 U.S.C. 154(b) by 462 days.

(21) Appl. No.: 12/478,363

(22) Filed: Jun. 4, 2009

(65) Prior Publication Data

US 2010/0307365 A1 Dec. 9, 2010

(51) Int. Cl.
*F41A 33/00* (2006.01)

(52) U.S. Cl. ..... 434/11

(58) Field of Classification Search ..... 434/11, 434/16; 102/401, 407, 411, 424, 426, 428, 102/498

See application file for complete search history.

(56) References Cited

U.S. PATENT DOCUMENTS

| | | | | |
|---|---|---|---|---|
| 3,086,464 | A * | 4/1963 | Butler et al. | 102/407 |
| 4,690,061 | A * | 9/1987 | Armer et al. | 102/401 |
| 5,074,793 | A * | 12/1991 | Hambric et al. | 434/11 |
| 5,207,579 | A * | 5/1993 | Campagnuolo | 434/11 |
| 5,719,501 | A * | 2/1998 | Spektor et al. | 324/345 |
| 5,801,322 | A * | 9/1998 | Laine et al. | 102/401 |
| 5,877,448 | A * | 3/1999 | Denton et al. | 102/401 |
| 6,553,912 | B2 * | 4/2003 | Wygant | 102/498 |
| 7,083,414 | B2 * | 8/2006 | Sansolo | 434/11 |
| 7,387,073 | B2 * | 6/2008 | Bodley et al. | 102/498 |
| 8,011,928 | B1 * | 9/2011 | Schaeffer et al. | 434/11 |
| 2006/0123684 | A1 * | 6/2006 | Bunney | 42/60 |
| 2008/0280264 | A1 * | 11/2008 | Segall | 434/11 |

* cited by examiner

*Primary Examiner* — Kurt Fernstrom
(74) *Attorney, Agent, or Firm* — Sughrue Mion, PLLC

(57) ABSTRACT

A simulated land mine for use in a combat simulation or a simulated war game, comprising: a base frame with an opening facing upwards; an inner housing inserted into the base frame and including a first center hole formed vertically therethrough; a gas cylinder mounted in the first center hole and including a second center hole formed vertically therethrough, a gas chamber formed around the second center hole and a discharge aperture communicating the formers and being used for containing compressed gas; a valve mounted in the second center hole for sealing the discharge aperture; a receiving chamber formed at an upper part of the first center hole by the inner housing, the gas cylinder and the valve and being used to contain colored liquid or powder to be ejected; means for supporting the inner housing which enables the movement of the inner housing in relation to the base frame; and a means for actuating the valve to selectively open the discharge aperture to release the compressed gas from the gas chamber into the receiving chamber.

20 Claims, 4 Drawing Sheets

SIMULATED LAND MINE

FIELD OF THE INVENTION

The present invention relates generally to land mines, and more particularly to land mines for use in a combat simulation or a simulated war game.

BACKGROUND OF THE INVENTION

Currently, to produce a scenario environment for a combat simulation or a simulated war game, simulated land mines are usually used. Such kind of simulated land mine generally involves a gas container containing compressed gas, a liquid container containing colored liquid, and a piercer for piercing the gas container. When the land mine is triggered, the piercer would pierce the gas container to release the compressed gas contained therein, and the released gas would force the colored liquid to eject from the liquid container. Thus, the individuals around the land mine would be marked by the colored liquid as being eliminated from the combat simulation or simulated war game.

However, as the gas container could no longer contain compressed gas after being pierced, the gas container or even the whole land mine should be replaced. Thus, the cost for the combat simulation or simulated war game would be relatively higher.

Besides, at the initial stage after the piercer pieces the gas container, the gas would leak out of the gas container slowly due to the existence of the piercer in the hole formed by the piercer on the gas container. Thus, the force of the gas ejecting the colored liquid is not large enough and the sound generated by the leakage of the gas is also not loud enough to generate a vivid explosion scene.

SUMMARY OF THE INVENTION

The present invention mainly aims to provide a simulated land mine for use in a combat simulation or a simulated war game to overcome the above-mentioned drawbacks.

The goal of the present invention is achieved by means of a simulated land mine for use in a combat simulation or a simulated war game, comprising: a base frame with an opening facing upwards; an inner housing inserted into the base frame through the opening and including a first center hole formed vertically therethrough; a gas cylinder mounted in the first center hole of the inner housing, which gas cylinder includes a second center hole formed vertically therethrough, a gas chamber formed around the second center hole and a discharge aperture communicating the gas chamber and the second center hole and being used for containing compressed gas; a valve mounted in the second center hole of the gas cylinder for sealing the discharge aperture; a receiving chamber formed at an upper part of the first center hole by the inner housing, the gas cylinder and the valve and being used to contain colored liquid or powder to be ejected; means for supporting the inner housing which enables the movement of the inner housing in relation to the base frame; and a means for actuating the valve to selectively open the discharge aperture to release the compressed gas from the gas chamber into the receiving chamber.

The means for supporting the inner housing includes a bracket provided within the base frame and a first spring provided between the bracket and an inner bottom of the base frame for tending to push the bracket away from the inner bottom of the base frame, while the means for actuating the valve is a striker fixedly mounted on the inner bottom of the base frame, which striker extends upwards into a through hole formed at the center of the bracket to align with the valve.

An advantage of the present invention is that the simulated land mine could be reused by just re-filling the gas chamber with compressed gas and re-filling the receiving chamber with colored liquid or powder, and no component in the land mine needs to be replaced for such reuse.

Since the inner housing, the gas cylinder and the valve are all supported on the bracket, most of the weight of the land mine is distributed equally on the bracket. Therefore, even when the land mine is stepped on at a corner of the cover, the inner housing together with the gas cylinder and valve could be pressed downwards smoothly without any jam or failure. Thus, a further advantage of the present invention is that the simulated land mine could always be triggered smoothly without any failure.

Another advantage of the present invention is that the force generated by rapid discharge of the compressed gas is large enough to eject the sufficient colored liquid or powder from the receiving chamber to generate a vivid explosion scene.

A still another advantage of the present invention is that the rapid discharge of the compressed gas also generate a loud sound to produce a further vivid explosion scene.

BRIEF DESCRIPTION OF THE DRAWINGS

The embodiments of the present invention will be described in detail with reference to the accompanying drawings. The figures are for illustration purposes only and are not drawn to scale, in which.

DETAILED DESCRIPTION OF THE INVENTION

Figure 1:
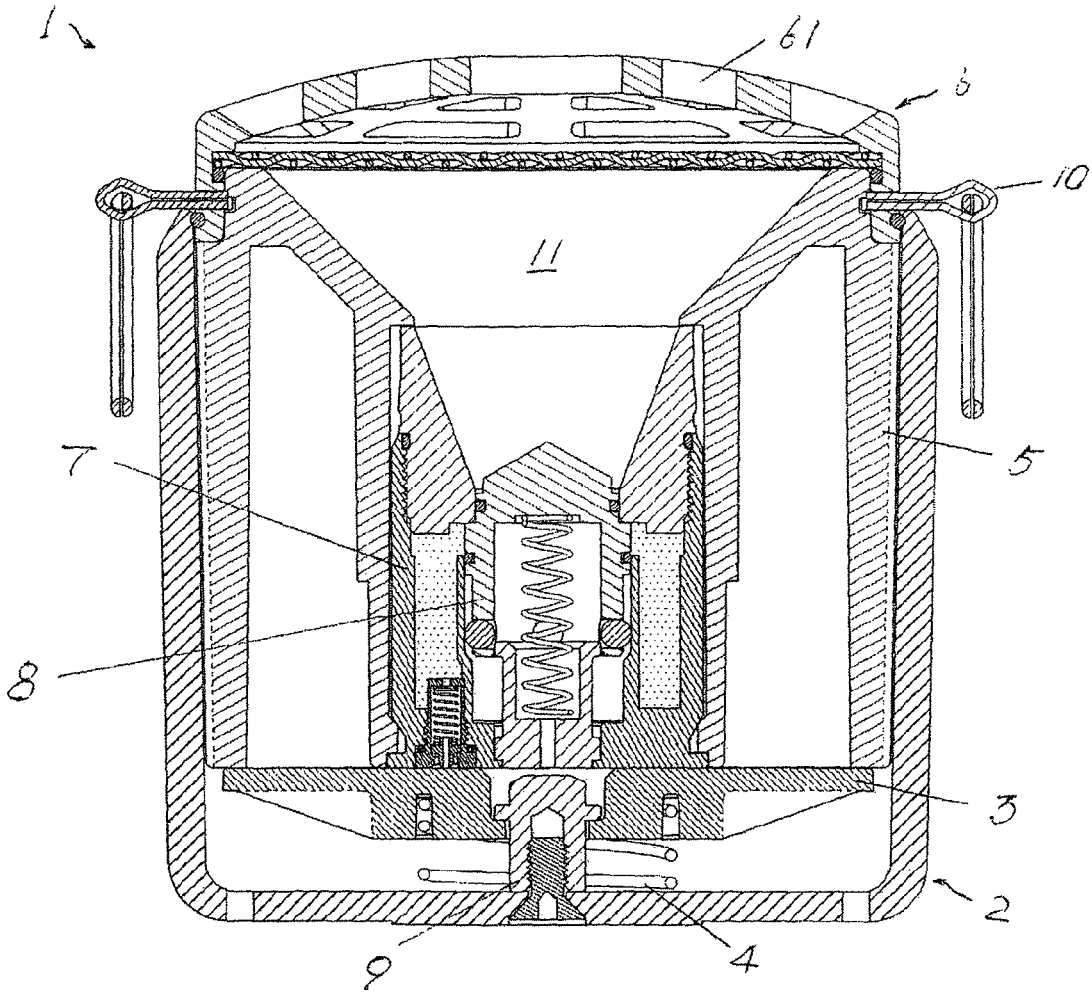
FIG. 1 is a cross section view of an embodiment of a simulated land mine according to the present invention.
Figure 2:
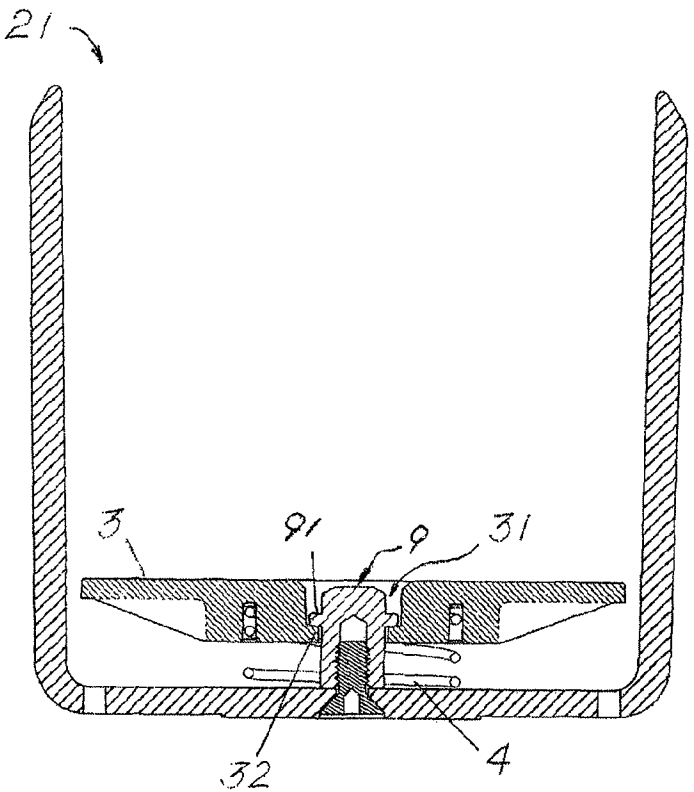
FIG. 2 is a cross section view of a base housing of the simulated land mine of FIG. 1.

With reference to FIGS. 1-2, the reference numeral 1 generally denotes the simulated land mine of the present invention. The simulated land mine 1 comprises a base frame 2 with an opening 21 facing upwards and an inner housing 5 inserted into the base frame 2 through the opening 21. The inner housing 5 is supported on a bracket 3 provided within the base frame 2. Between the bracket 3 and an inner bottom of the base frame 2, a first spring 4 is provided which tends to push the bracket 3 away from the inner bottom of the base frame 2. With the support of the bracket 3 and first spring 4, the inner housing 5 is movable in relation to the base frame 2 by pressing or releasing the inner housing 5.

Figure 3:
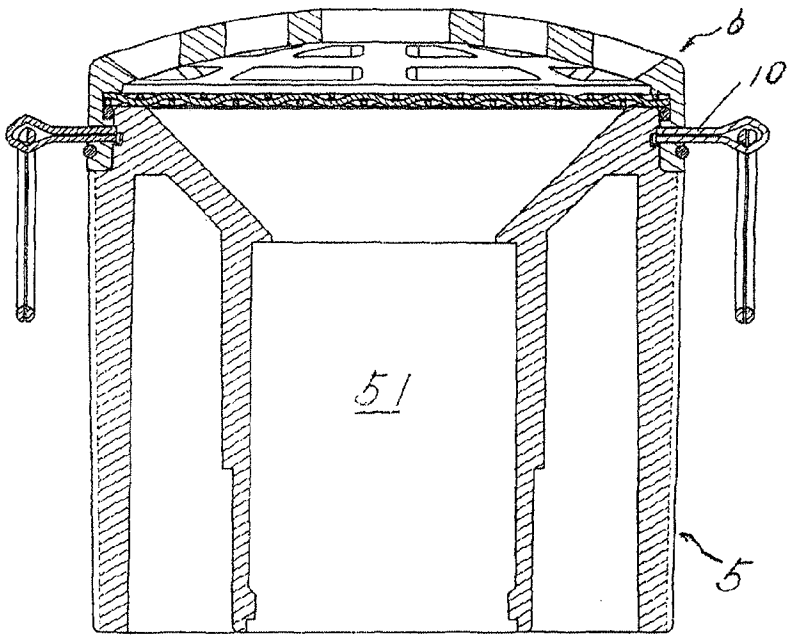
FIG. 3 is a cross section view of an inner housing and a cover of the simulated land mine of FIG. 1.

Particularly, as shown in FIG. 3, the inner housing 5 comprises a first center hole 51 formed vertically therethrough. A cover 6 with a plurality of discharge openings 61 is provided at the top of the inner housing 5 to cover the first center hole 51. To retain the downward movement of the inner housing 5 with respect to the base frame 2, a safety pin 10 may be inserted into a wall of the inner housing 5 through the cover 6 and press against the tip of the base frame 2. After removing the safety pin 10, the inner housing 5 could move freely with respect to the base frame 2.

Figure 4:
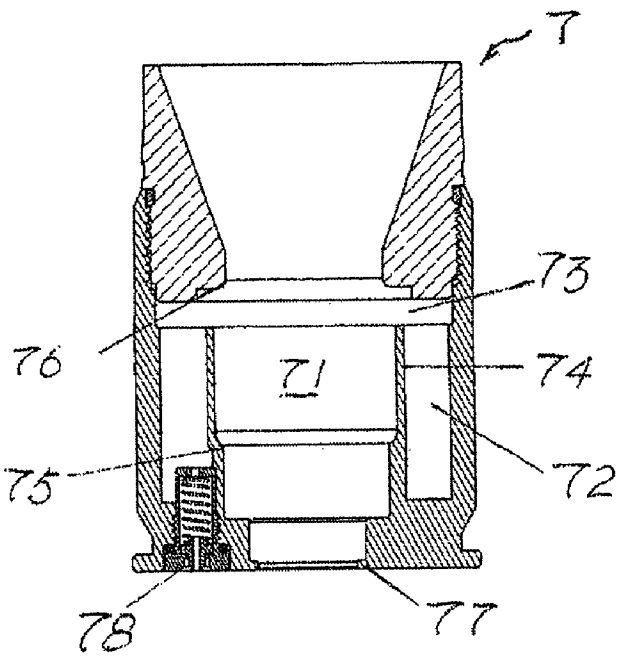
FIG. 4 is a cross section view of a gas cylinder of the simulated land mine of FIG. 1.

As shown in FIGS. 1 and 4, a gas cylinder 7 is mounted in the first center hole 51 of the inner housing 5. Preferably, the gas cylinder 7 is mounted in such a manner that the bottom of the gas cylinder 7 is also supported on the bracket 3.

The gas cylinder 7 includes a second center hole 71 formed vertically therethrough, and a gas chamber 72 formed around the second center hole 71 and spaced from the center second hole 71 by a spacer 74. A discharge aperture 73 is formed at an upper part of the spacer 74 for communicating the gas chamber 72 and the second center hole 71. Preferably, the discharge aperture 73 is a circular aperture formed around the second center hole 71. A step section 75 is formed on an inner surface of the spacer 74 at a lower part thereof, in which the inner diameter of the second center hole 71 at the step section 75 is slightly smaller than that above this section. An upper circular projection 76 extends inward towards the center of the second center hole 71 above the discharge aperture 73. At the bottom of the second center hole 71, a plurality radially spaced apart lower projections 77 are formed around the second center hole 71. Preferably, the lower projections connect with each other to form a circular projection. A charge valve 78 could be provided in the gas cylinder 7 for charging the gas chamber 72 with compressed gas when the discharge aperture 73 is closed. Any charge valve well known in the art could be used in the present invention, and the detailed description thereof is omitted. The compressed gas could be compressed air or other inert gases or the mixture thereof.

As shown in FIG. 1, the present invention further comprises a valve 8 provided within the second center hole 71 of the gas cylinder 7 for selectively closing the discharge aperture 73. Therefore, the inner housing 5, the gas cylinder 7 and the top of the valve 8 form a receiving chamber 11 at an upper part of the first center hole 51. The receiving chamber 11 is used to contain colored liquid or powder to be ejected from the land mine when the latter is triggered. To enlarge the volume of the receiving chamber, the upper part of the first center hole 51 could have a shape of inverted cone, and preferably the upper part of second center hole 71 of the gas cylinder 7 could also have a shape of inverted cone.

Figure 5:
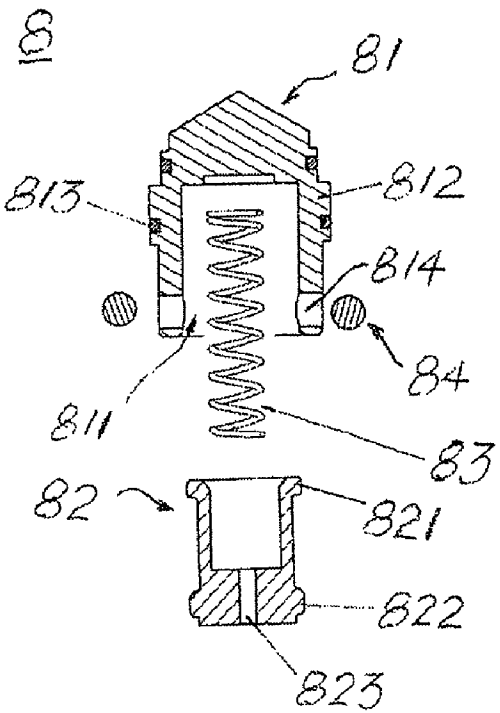
FIG. 5 is a explosive view of a valve of the simulated land mine of FIG. 1.

FIG. 5 illustrates the valve 8 of the present invention in detail. The valve 8 includes a valve body 81 with a blind hole 811 formed at the center of the valve body from the lower side thereof, a valve core 82 partially received in the blind hole 811, and a second spring 83 provided between the valve body 81 and valve core 82 and tending to separate them from each other.

A circular protrusion 812 is formed around an outer surface of the valve body 81 at an upper part thereof. The upper end surface of the circular protrusion 812 presses against the circular projection 76 of the gas cylinder 7, while the diameter and thickness of the circular protrusion 812 are sized to cover the discharge aperture 73 to seal the latter. To seal the discharge aperture 73 tightly, a pair of O-rings 813 may be provided on the valve body 81 above and below the discharge aperture respectively.

A plurality of radially spaced apart receiving holes 814 are formed through a side wall of the valve body 81 at the lower part thereof. A ball 84 is provided within each of receiving holes 813. The diameter of the ball 84 is slightly smaller than the inner diameter of its respective receiving hole 814, but is slightly larger than the distance from the inner surface of the side wall of the valve body to the inner surface of the spacer 74. The ball could be made of metals, rigid plastics, ceramics, alloys or any other rigid materials.

The valve core 82 comprises an upper flange 821 and a lower flange 822 formed at an upper and a lower part thereof respectively. The diameter of the upper flange 821 is slightly smaller that that of the blind hole 811 of the valve body 81 to enable the upper flange to be movable freely therein. The lower flange 822 is received on the projections 77 formed at the bottom the second center hole 71, to support the whole valve 8 within the second center hole. In this case, the second spring 83 push the valve body 81 upwards to enable the upper end surface of the circular protrusion 812 to press against the circular projection 76 of the gas cylinder 7 tightly. At the same time, the upper flange 822 of the valve core 82 presses against the balls 84 received in the receiving holes 814, and the valve body 81 is thus fixed to the gas cylinder 7 by the force generated from the contact of the balls 84 and the spacer 74, and the discharge aperture 73 is sealed by the circular protrusion 812 of the valve 8. Preferably, a discharge hole 823 could be formed in the valve core 82 for discharging gas, liquid or powder entering into the blind hole.

Return to FIGS. 1 and 2, in order to actuate the valve 8 to release the discharge aperture 73 of the gas cylinder 7, a striker 9 is fixedly mounted on the inner bottom of the base frame 2. The striker 9 extends upwards into a through hole 31 formed at the center of the bracket 3, to align with the bottom of the valve core 82. The tip of the striker 9 is slightly below or flushes with the top surface of the bracket 3.

Preferably, a plurality of radially spaced apart projections 32 may extend inward towards the center of the though hole 31 at the lower part of the latter, while a flange 91 may be formed at the upper part of the striker 9. Therefore, the flange 91 of the striker 9 presses against the projections 32 of the bracket 3, to limit the distance the bracket 3 is pushed away from the inner bottom of the base frame 2 by the first spring 4. Preferably, the projections 32 may connect with each other to form a circular projection.

The operation of the simulated land mine of the present invention is described in detail with reference to FIG. 6.

At first, the land mine of the present invention is set in the ground with the gas chamber 72 filled with compressed gas and the receiving chamber 11 filled with the colored liquid or powder. Then, the safety pin 10 is removed from the land mine to allow the movement of the inner housing 5 with respect to the base frame 2. When a participant in the combat simulation or simulated war game steps on the cover 6 of the land mine (as indicated by arrow A in the FIG. 6), the inner housing 5 would be pressed and moved downwards together with the bracket 2 with respect to the base frame 2 against the first spring 4, thus, the gas cylinder 7 attached to the inner housing 5 and the valve 8 supported on the gas cylinder 7 would also be moved downwards together with inner housing 5.

Figure 6:
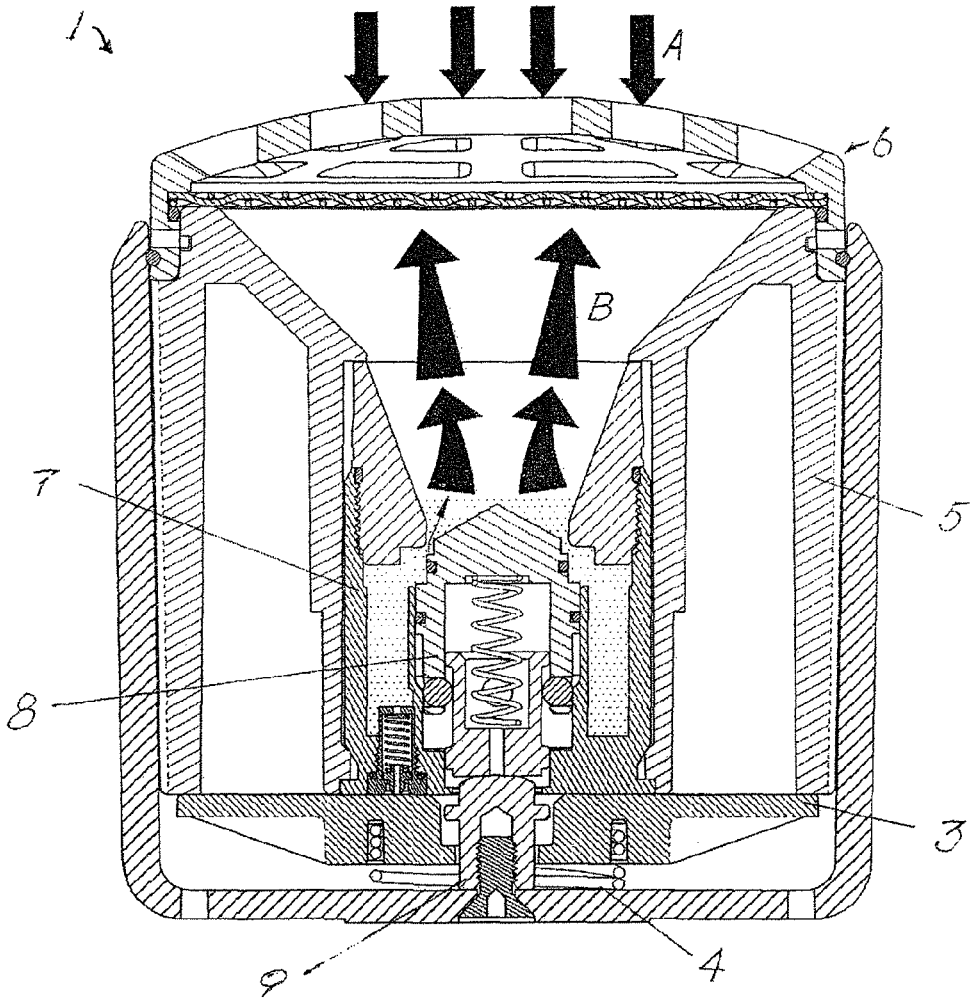
FIG. 6 is a cross section view of the simulated land mine of FIG. 1 during the operation.

As shown in FIG. 6, as the inner housing 5, the gas cylinder 7 and the valve 8 are all supported on the bracket 2, most of the weight of the land mine is distributed equally on the bracket 2. Therefore, even when the land mine is stepped on at a corner of the cover 6, the inner housing 5 together with the gas cylinder 7 and valve 8 could be pressed downwards smoothly without any jam or failure.

At this time, the striker 9 protrudes from the through hole 31 of the bracket 3 to contact the valve core 82 of the valve 8, thus the valve core 82 is prevent from further moving downwards. Subsequently, with the further downward movement of the valve body 81 together with the gas cylinder 8, the valve core 82 is pushed upwards with respect to the valve body 81, and the upper flange 822 thereof would move across the balls 84 of the valve 8 and release the pressure applied on the balls 84. With the release of the pressure on the balls 84, the force generated by the contact of the balls and spacer 74 is lowered or even disappears, and then the valve body 81 could not be tightly attached to the gas cylinder 7 any longer.

Consequently, the pressure applied on the valve body 81 by the compressed gas in the gas chamber 72 forces the valve body 81 to move downwards rapidly against the second spring 83, thus the discharge aperture 73 is opened. When the balls 84 is further moved downwards by the valve body 81 to reach the step section 75 of the spacer 74, they would be moved inwards into the receiving hole 814. Thus, the valve body 81 would be further moved downwards to open the discharge aperture 73 completely. Then, the compressed gas is discharged rapidly from the gas chamber 72 through the discharge aperture 73, and the rapid discharge of compressed gas eject the colored liquid or powder contained in the receiving chamber 11 through the discharge openings 61 of the cover 6 (as indicated by the arrow B in the FIG. 6) and generate loud sound at the same time. The participants around the land mine would be stained by the ejected liquid or powder as being eliminated from the combat simulation or simulated war game.

After the cover 6 is released and the air pressure within the gas chamber 72 is balanced to the external air pressure with the discharge of the compressed gas, the bracket 3 is pushed upwards by the first spring 4 to move away from the inner bottom of the base frame 2. Thus, the inner housing 5 supported on the bracket 3 as well as the gas cylinder 7 and valve 8 would be also moved upwards by the bracket 3. Subsequently, the valve core 82 separates from the striker 9, thus the second spring 83 of the valve 8 forces the valve body 81 and valve core 82 to move away from each other. Thus, the lower flange 823 of the valve core 82 is pushed upwards to press against the projections 77 and be supported on the latter, while valve body 81 is pushed upwards to press against the circular projection 76 of the gas cylinder 7 to seal the discharge aperture 73. At the same time, the upper flange 822 of the valve core 82 moves downwards onto the balls 84 and press the balls 84 tightly against the spacer 74 of the gas cylinder 7.

After the gas chamber 72 is re-charged with compressed gas and the receiving chamber is re-filled with colored liquid or powder, the simulated land mine of the present invention could be reused without replacement of any components thereof.

Although the description of the present invention is made with reference to the preferred embodiments, the present invention is not limited to these embodiments. Various modifications and changes can be made to the invention by those skilled in the art without departing from the spirit and scopes of the present invention.

What is claimed is:

1. A simulated land mine for use in a combat simulation or a simulated war game, comprising:

a base frame with an opening facing upwards;

an inner housing inserted into the base frame through the opening and including a first center hole formed vertically therethrough;

a gas cylinder mounted in the first center hole of the inner housing, which gas cylinder includes a second center hole formed vertically therethrough, a gas chamber formed around the second center hole and a discharge aperture communicating the gas chamber and the second center hole and being used for containing compressed gas;

a valve mounted in the second center hole of the gas cylinder for sealing the discharge aperture;

a receiving chamber formed at an upper part of the first center hole by the inner housing, the gas cylinder and the valve and being used to contain colored liquid or powder to be ejected;

means for supporting the inner housing which enables the movement of the inner housing in relation to the base frame; and a means for actuating the valve to selectively open the discharge aperture to release the compressed gas from the gas chamber into the receiving chamber.

2. The simulated land mine of claim 1, wherein the means for supporting the inner housing includes a bracket provided within the base frame and a first spring provided between the bracket and an inner bottom of the base frame for tending to push the bracket away from the inner bottom of the base frame.

3. The simulated land mine of claim 2, wherein a spacer is formed between the second center hole and the gas chamber to separate them from each other, and the discharge aperture is formed at an upper part of the spacer.

4. The simulated land mine of claim 3, wherein the discharge aperture is a circular aperture around the second center hole.

5. The simulated land mine of claim 3, wherein a step section is formed on an inner surface of the spacer at a lower part thereof in which the inner diameter of the second center hole at the step section is slightly smaller than that above this section, an upper circular projection extends inward towards the center of the second center hole above the discharge aperture, and a plurality radially spaced apart lower projections are formed around the second center hole at the bottom of the second center hole.

6. The simulated land mine of claim 5, wherein the lower projections connect with each other to form a circular projection.

7. The simulated land mine of the claim 5, wherein a charge valve is provided in the gas cylinder for charging the gas chamber with compressed gas when the discharge aperture is closed.

8. The simulated land mine of claim 7, wherein the compressed gas is compressed air, compressed inert gases or the mixture thereof.

9. The simulated land mine of claim 5, wherein the valve includes a valve body with a blind hole formed at the center thereof from the lower side, a valve core partially received in the blind hole, and a second spring provided between the valve body and the valve core and tending to separate them from each other.

10. The simulated land mine of claim 9, wherein a circular protrusion is formed around an outer surface of the valve body at an upper part thereof, and an upper end surface of the circular protrusion is used to press against the upper circular projection of the gas cylinder, while the diameter and thickness of the circular protrusion are sized to cover the discharge aperture to seal the latter.

11. The simulated land mine of claim 10, wherein a plurality of radially spaced apart receiving holes are formed through a side wall of the valve body at a lower part thereof, and a ball is provided within each of the receiving holes, in which the diameter of the ball is slightly smaller than the inner diameter of the respective receiving hole, but is slightly larger than the distance from an inner surface of the side wall of the valve body to the inner surface of the spacer.

12. The simulated land mine of claim 11, wherein the balls are made of metals, rigid plastics, ceramics, alloys or other rigid materials.

13. The simulated land mine of claim 11, wherein the valve core includes an upper flange formed at an upper part of the valve core for pressing the balls against the spacer upon contacting the balls, and a lower flange formed at a lower part of the valve core for being supporting on the lower projections of the gas cylinder, in which the diameter of the upper flange is slightly smaller that that of the blind hole of the valve body to enable the upper flange to be movable freely therein.

14. The simulated land mine of claim 13, wherein a discharge hole is formed in the valve core for discharging gas, liquid or powder entering into the blind hole.

15. The simulated land mine of claim 13, wherein the means for actuating the valve is a striker fixedly mounted on the inner bottom of the base frame, which striker extends upwards into a through hole formed at the center of the bracket to align with an bottom of the valve core.

16. The simulated land mine of claim 15, wherein a plurality of radially spaced apart projections extend inward towards the center of the though hole of the bracket at a lower part thereof, while a flange is formed at a upper part of the striker for pressing against the projections of the bracket to limit the distance the bracket is pushed away from the inner bottom of the base frame by the first spring.

17. The simulated land mine of claim 16, wherein the projections of the brackets connect with each other to form a circular projection.

18. The simulated land mine of claim 1 further comprising a cover provided at the top of the inner housing for covering the first center hole, and a plurality of discharge openings are formed in the cover for the passage of the colored liquid or powder.

19. The simulated land mine of claim 1 further comprising a safety pin for retaining the movement of the inner housing in relation to the base frame.

20. The simulated land mine of claim 1 further comprising a plurality of O-rings provided between the valve and the gas cylinder for preventing the leakage of the compressed gas from the gas chamber.

* * * * *